US009111430B2

(12) United States Patent
Kraus et al.

(10) Patent No.: US 9,111,430 B2
(45) Date of Patent: Aug. 18, 2015

(54) SECURITY SYSTEM FOR A BUILDING

(76) Inventors: Mark Kraus, Bloomfield Hills, MI (US); Paul Toenjes, Grosse Pte Farms, MI (US)

( * ) Notice: Subject to any disclaimer, the term of this patent is extended or adjusted under 35 U.S.C. 154(b) by 687 days.

(21) Appl. No.: 13/173,051

(22) Filed: Jun. 30, 2011

(65) Prior Publication Data

US 2012/0001754 A1 Jan. 5, 2012

Related U.S. Application Data

(60) Provisional application No. 61/359,946, filed on Jun. 30, 2010.

(51) Int. Cl.

| | |
|---|---|
| ***G08B 13/00*** | (2006.01) |
| ***G08B 25/00*** | (2006.01) |
| *G08B 13/196* | (2006.01) |
| *G08B 25/12* | (2006.01) |

(52) U.S. Cl.

CPC ..... *G08B 25/005* (2013.01); *G08B 25/004* (2013.01); *G08B 13/19697* (2013.01); *G08B 25/12* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,166,972 | A | 11/1992 | Smith | |
| 6,366,646 | B1 | 4/2002 | Miller | |
| 6,650,746 | B1 | 11/2003 | Groen et al. | |
| 6,658,104 | B1 | 12/2003 | Carrion et al. | |
| 6,735,285 | B2 | 5/2004 | Orwick et al. | |
| 6,807,564 | B1 * | 10/2004 | Zellner et al. | 709/206 |
| 6,965,868 | B1 | 11/2005 | Bednarek | |
| 7,126,472 | B2 | 10/2006 | Kraus et al. | |
| 7,477,142 | B2 | 1/2009 | Albert et al. | |
| 2002/0130002 | A1 | 9/2002 | Hopkins et al. | |
| 2005/0136885 | A1 | 6/2005 | Kaltsukis | |
| 2005/0219044 | A1 * | 10/2005 | Douglass et al. | 340/506 |
| 2006/0176167 | A1 * | 8/2006 | Dohrmann | 340/506 |
| 2007/0083918 | A1 | 4/2007 | Pearce et al. | |
| 2007/0171898 | A1 | 7/2007 | Salva | |
| 2007/0290830 | A1 * | 12/2007 | Gurley | 340/506 |
| 2008/0117029 | A1 * | 5/2008 | Dohrmann et al. | 340/286.02 |
| 2008/0186208 | A1 * | 8/2008 | Knoska et al. | 340/984 |
| 2009/0070682 | A1 * | 3/2009 | Dawes et al. | 715/736 |
| 2009/0086943 | A1 | 4/2009 | Jain et al. | |
| 2010/0295656 | A1 * | 11/2010 | Herickhoff et al. | 340/3.1 |

* cited by examiner

*Primary Examiner* — Travis Hunnings
(74) *Attorney, Agent, or Firm* — Dickinson Wright PLLC

(57) ABSTRACT

A method of operating a security system (20) including a plurality of sensors (30) and cameras (34). The security system (20) includes a monitoring device (24) and a monitoring database (32), at least one of which stores a plurality of contacts and notification methods for contacting the contacts. When one of the sensors (30) or cameras (34) detects an emergency condition, one of the monitoring device (24) or monitoring database (32) automatically sends a notification message to one of the contacts. If the contact rejects the notification message or does not respond, then the monitoring device (24) or monitoring database (32) automatically sends the notification message to the same contact through a different notification method or to a different contact.

15 Claims, 3 Drawing Sheets

SECURITY SYSTEM FOR A BUILDING

CROSS REFERENCE TO RELATED APPLICATION

This application claims the benefit of application Ser. No. 61/359,946 filed on Jun. 30, 2010.

BACKGROUND OF THE INVENTION

1. Field of the Invention

The invention relates to a method of operating a security system in a building.

2. Description of the Prior Art

Security systems for protecting buildings are well known and widely used. One such security system and a method for operating that security system including a monitoring device is shown in United States patent application publication number 2007/0290830, to Scott A. Gurley and published on Dec. 20, 2007 (hereinafter referred to as "Gurley '830"). The Gurley '830 patent shows a method of operating the security system including the step of establishing at least one contact (a subscriber device) and a first notification method for contacting the contact. The Gurley '830 method continues with the step of establishing an emergency condition with the monitoring device. Once the emergency condition is established, the Gurley '830 method continues with the step of automatically sending a notification message to the contact via the first notification method. The Gurley '830 method proceeds with the step of receiving a response from the contact as one of accepted and rejected and unresponsive. If the contact accepts the message, then the monitoring device and the contact may communicate with one another to allow the contact to determine how to handle the emergency condition. If the contact device does not accept the notification message from the monitoring device, the emergency would go unanswered. There remains a significant need for improved methods of operating security systems for protecting buildings.

SUMMARY OF THE INVENTION

The invention provides for such a method and including the step of automatically sending the notification message to at least one of the same contact through a different notification method than the first notification method and to a different contact until the monitoring device receives an accepted response from one of the contacts.

ADVANTAGES OF THE INVENTION

The subject invention is advantageous because it increases the chances for someone to receive the notification message that there has been an emergency condition in the building. Often a contact will be unable to accept the notification through the first notification message. The security system operating according to the method of the subject invention could either send the notification message to that first contact through a different notification method, or it could send the notification message to a different contact though any notification method. A subscriber to the security system could determine in advance the order in which the notification methods are processed, and the subscriber could be one of the contacts to be contacted in the event of an emergency condition.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
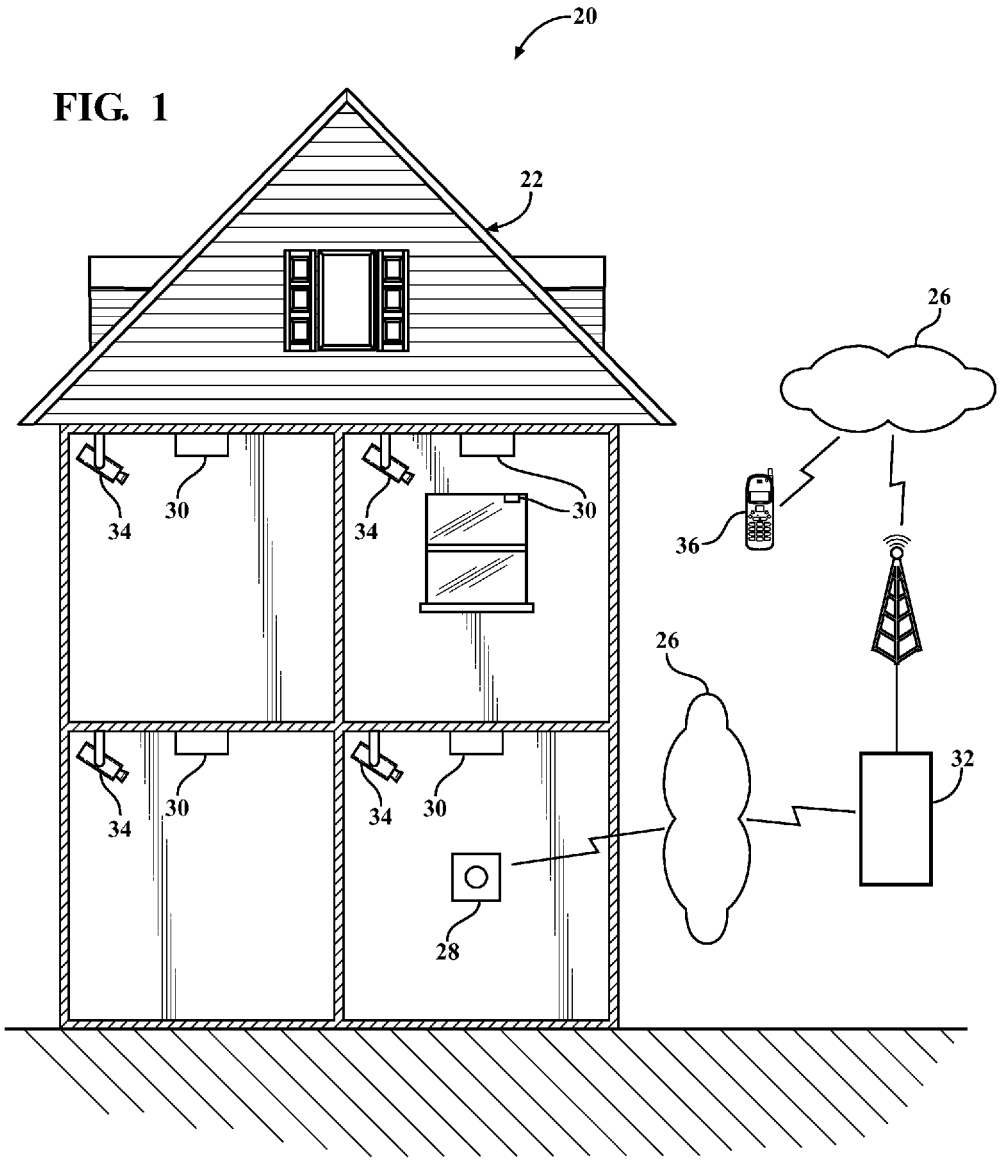
FIG. 1 is a front view of a building including the exemplary embodiment of the security system.
Figure 2A:
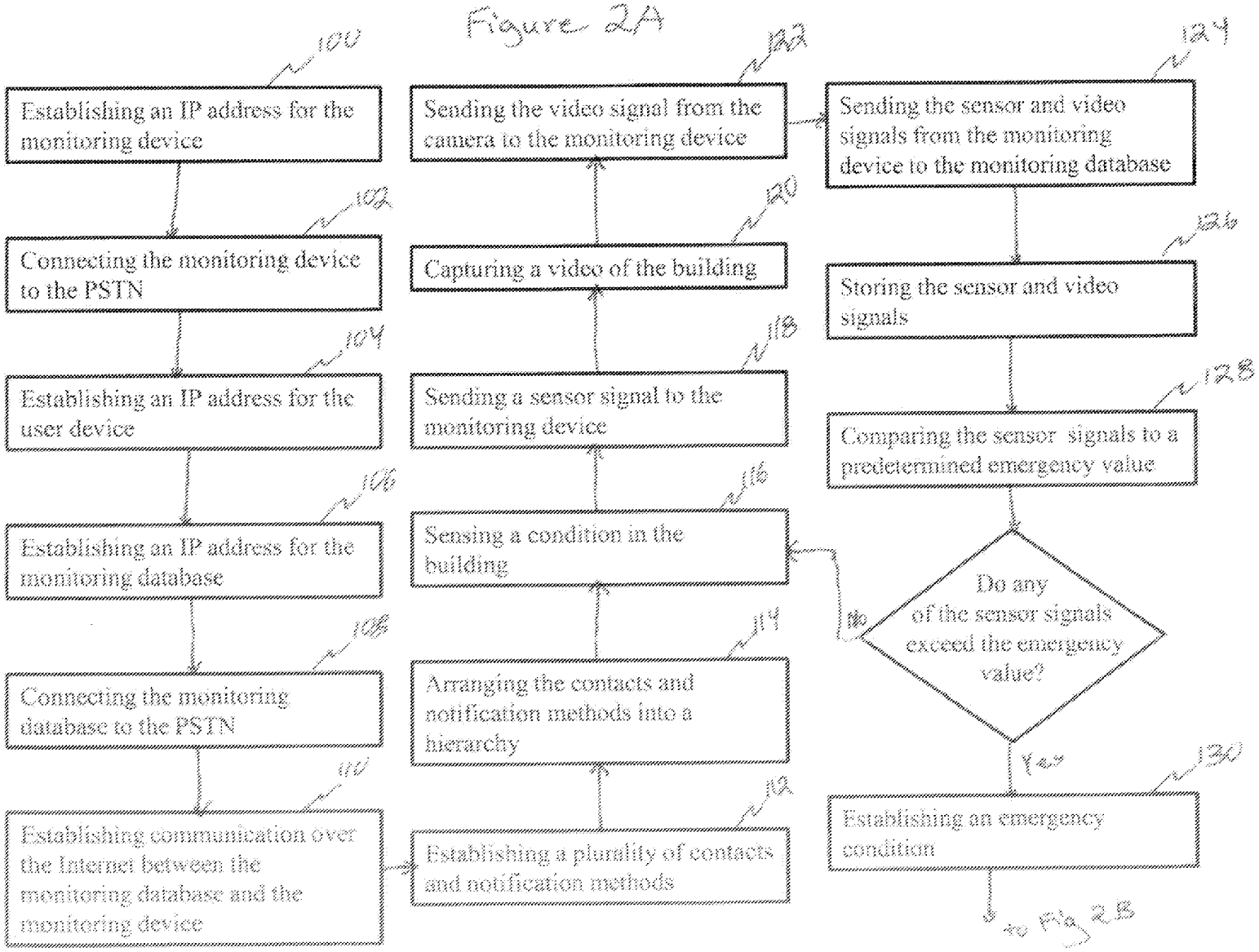
FIG. 2 is a flowchart of the method of operating the security system.
Figure 2B:
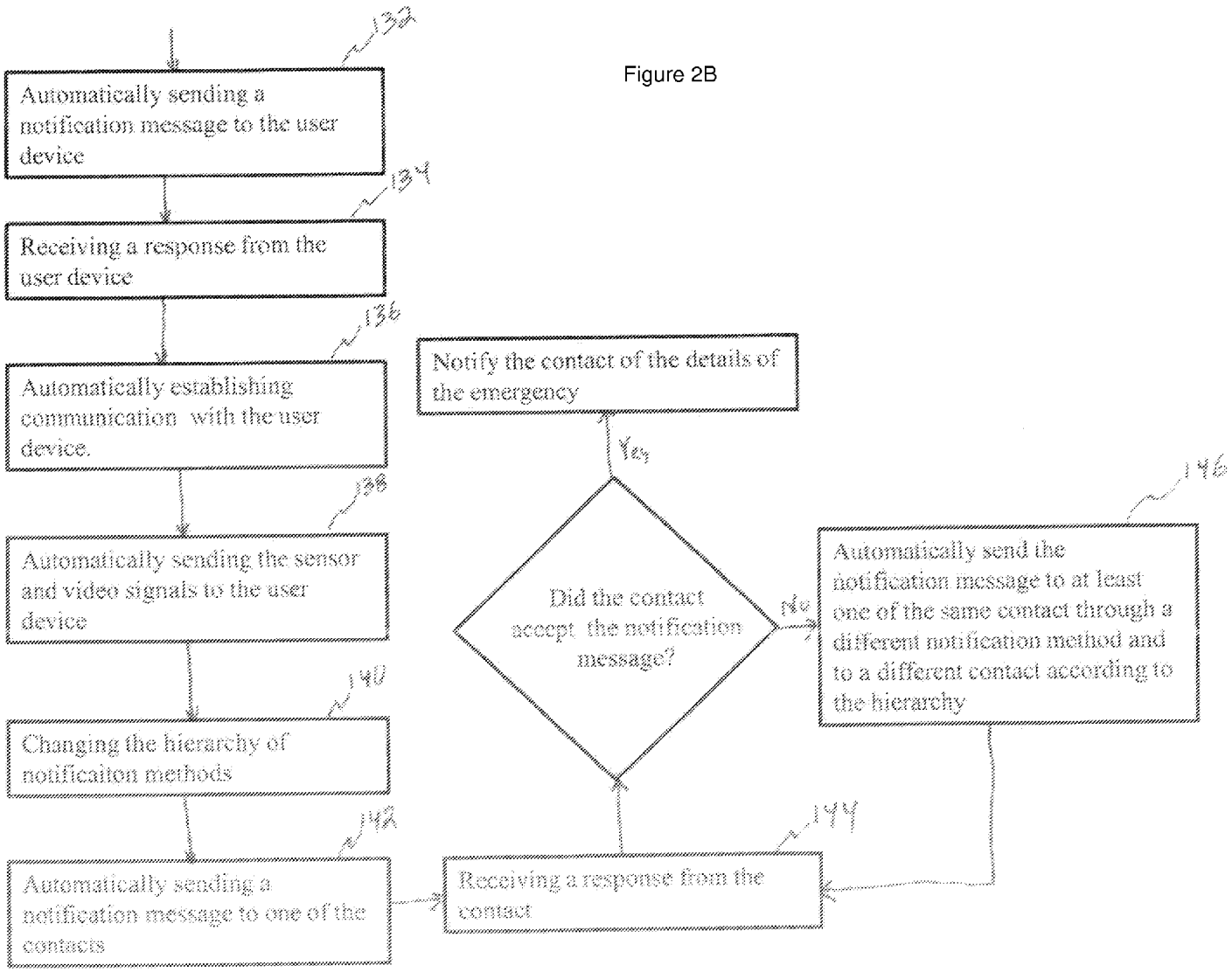

Referring to the Figures, wherein like numerals indicate corresponding parts throughout the several views, a security system 20 for a building 22 is generally shown in FIG. 1. As illustrated, the security system 20 is located in a house, but it should be appreciated that the security system 20 could be used in any building 22, commercial or residential.

The security system 20 includes a monitoring device 24 that is connected to the Internet 26 and to the public switched telephone system (PSTN). The monitoring device 24 includes a panic button 28 for depressing in the event of an emergency. The monitoring device 24 effectively acts as the nerve center of the security system 20 and controls each of the components, which will be discussed in further detail below. The monitoring device 24 is connected to the Internet 26 using any method of connection, e.g. Ethernet, Wi-fi, cellular network, satellite, etc. Preferably, the monitoring device 24 remains in the building 22 at all times and includes a back-up battery (not shown) to provide power to the home monitoring device 24 if the building 22 loses electricity. The monitoring device 24 further includes a memory for storing signals and contacts as will be discussed in further detail below.

A plurality of sensors 30 are positioned throughout the building 22 for monitoring a plurality of conditions in the building 22. Among other conditions, the sensors 30 could monitor motion, moisture, sounds, pressure, vibration, carbon dioxide, carbon monoxide, heat, smoke, power surges or structural openings (doors or windows). Each of the sensors 30 generates a sensor 30 signal, which is sent either through wires or wirelessly to the monitoring device 24. The sensors 30 may be connected through wires or wirelessly to the monitoring device 24. The sensors 30 are configured to monitor conditions in the building 22, e.g. motion, moisture, sounds, pressure, temperature, vibration, carbon dioxide ($CO_2$), carbon monoxide (CO), heat, smoke, power surge, or structural openings (doors or windows). All of the sensor 30 signals are collected by the monitoring device 24 and automatically stored on the memory in the monitoring device 24 or uploaded over the Internet 26 to a monitoring database 32, which will be discussed in further detail below.

A plurality of cameras 34 are positioned throughout the building 22 for capturing video of the building 22 and generating a plurality of video signals. The video signals are sent either through wires or wirelessly to the monitoring device 24. Like the sensor 30 signals, the video signals are collected by monitoring device 24 and either stored on the memory of the monitoring device 24 or uploaded over the Internet 26 to the monitoring database 32.

The security system 20 further includes a monitoring database 32 connected to the Internet 26 and to the PSTN. The monitoring database 32 is preferably in a location remote from the building 22. The monitoring database 32 communicates with the monitoring device 24 in the building 22 through the Internet 26, and the monitoring device 24 sends the condition and video signals to the monitoring database 32. The monitoring database 32 includes a memory for storing those signals and for making them available at a later time. For example, if the building 22 and the monitoring device 24 are destroyed by a fire, the location that the fire started from could be determined from the condition signals from the smoke and heat sensors 30. Also, the cause of the fire could be determined from the video taken by the cameras 34 positioned throughout the building 22. Alternatively, if the building 22 is broken into, the video taken by the cameras 34 in the building 22 can be used to determine the identity of the robber.

The security system 20 also includes a user device 36 connected to the Internet 26 for remotely connecting to the monitoring device 24. The user device 36 could be a smartphone or a standalone device. The monitoring device 24 sends the condition and video signals to the user device 36 over the Internet 26. In other words, a person using the user device 36 can view the conditions of the building 22 as monitored by the sensors 30 or view the video being captured by the cameras 34 from any place that the user device 36 is connected to the Internet 26. In addition to being useful in emergency conditions, this remote monitoring capability is beneficial in many non-emergency conditions. The user device 36 can also change the settings of the security system 20 and adjust the video cameras 34.

Like the monitoring device 24, the monitoring database 32 also includes a memory. A list of contacts and at least one notification method for contacting each contact are stored the memories of either the monitoring database 32, the monitoring device 24, or both the monitoring device 24 and the monitoring database 32. Each notification method could be a telephone number for calling the contact, a telephone number for sending a short messaging service (SMS) message to the contact, a pager number for sending a pager message or an email address for sending an email address. The contacts could be the user device 36, residents who live in the building 22, employees who work in the building 22, family of the residents of the building 22, the local police department, the local fire department or any other desired contact.

The contacts and notification methods are arranged in a priority order, or a hierarchy, based on priority. The hierarchy of contacts and notification messages can vary according to the time of day, the day of the week, the location in the building 22 of the emergency condition or the type of emergency. One example of the hierarchy changing based the time of the day is a situation where a contact's work phone number could be at the top of the hierarchy during business hours and that contact's home phone number could be at the top of the hierarchy after business hours. One example of the hierarchy changing based on the day of the week is where a contact's home telephone number is at the top of the hierarchy during week days and the same contact's cellular telephone number is at the top of the hierarchy during weekends. One example of the hierarchy changing based on the location in the building 22 of the emergency condition is where a sensor 30 on the east side of the house senses that a window is broken, then the notification method at the top of hierarchy could the home phone number of a neighbor who lives to the east of the building 22. Finally, one example of the hierarchy changing based on the type of emergency is where the number for the local fire department is at the top of the hierarchy for all emergency conditions related to the smoke sensors 30. A subscriber may access and modify the hierarchy of contact methods for each contact through the user device 36 or any web-based application.

The subject invention also affords a method of operating a security system 20 for a building 22. The security system 20 includes a plurality of sensors 30, a plurality of cameras 34, a user device 36, a monitoring device 24 and a monitoring database 32. The method is illustrated in a flow chart shown in FIG. 10.

The method starts with the step 100 of establishing an internet 26 protocol (IP) address for the monitoring device 24 to connect the monitoring device 24 to the Internet 26. The method continues with the step 102 of connecting the monitoring device 24 to the public switched telephone network (PSTN). The method proceeds with the step 104 of establishing an internet 26 protocol (IP) address for the user device 36. The method then proceeds with the step 106 of establishing an internet 26 protocol (IP) address for the monitoring database 32. Thus, the monitoring device 24, the monitoring database 32, and the user device 36 may all communicate another through the Internet 26. The method also includes the step 108 of connecting the monitoring database 32 to the PSTN.

The method continues with the step 110 of establishing communication over the Internet 26 between the monitoring database 32 and the monitoring device 24. The method then continues with the step 112 of establishing a plurality of contacts and notification methods for contacting the contacts. As explained above, the contacts and notification methods could be stored on the memory of either the monitoring device 24 or the monitoring database 32. Once the contacts and notification methods are established, the method continues with the step 114 of arranging the notification methods into a hierarchy including a first notification method at the top of the hierarchy. As explained above, the hierarchy can be changed for different times of the day, days of the week, different locations of the building 22 that the emergency took place in or for different types of emergencies.

The method continues with the step 116 of sensing a condition of the building 22 with each of the sensors 30 and generating a sensor 30 signal associated with the sensed condition. As explained above, the conditions sensed by the sensors 30 could be related to motion, moisture, sounds, pressure, vibration, carbon dioxide, carbon monoxide, heat, smoke, power surges or structural openings (doors or windows). The method proceeds with the step 118 of sending the sensor 30 signals from the sensors 30 to the monitoring device 24. The method continues with the step 120 of capturing a video of the building 22 with each of the cameras 34 and generating a video signal. The method then proceeds with the step 122 of sending the video signals from the cameras 34 to the monitoring device 24. The method continues with the step 124 of sending the sensor 30 and video signals from the monitoring device 24 to the monitoring database 32 via the Internet 26. The method then continues with the step 126 of storing the sensor 30 and video signals on either the monitoring device 24 or the monitoring database 32.

The method proceeds with the step 128 of comparing each of the sensor 30 signals to a predetermined emergency value. Once each of the sensor 30 signals has been compared to the predetermined emergency value, the method continues with the step 130 of establishing an emergency condition with the monitoring device 24 in response to one of the sensor 30 signals exceeding the predetermined emergency value or in response to the panic button 28 on the monitoring device 24 being depressed. Preferably, it is the monitoring device 24 that compares the sensor 30 signals to the predetermined emergency values and establishes the emergency condition, but it could alternatively be the monitoring database 32 that does the comparison. For example, the predetermined emergency value for the carbon monoxide sensor 30 signal could be related to a carbon monoxide level of 30 parts per million (ppm). Once the carbon monoxide sensor 30 signal exceeds the predetermined value associated with 30 ppm, then the monitoring device 24 establishes the emergency condition.

The method continues with the step 132 of automatically sending a notification message to the user device 36 in response to an emergency condition being established. The method proceeds with the step 134 of receiving a response from the user device 36 as one of accepted and rejected and unresponsive. Either the monitoring device 24 or the monitoring database 32 could perform the steps of sending the notification message to the user device 36 and receiving the response from the user device 36. The method continues with the step 136 of receiving a response from the user device 36 as one of accepted, rejected or unresponsive. If the user device 36 accepts the notification message, then the method continues with the step of automatically establishing communication between the user device 36 and the monitoring device 24 and/or the monitoring database 32. Once communication between the user device 36 and the monitoring device 24 and/or the monitoring database 32 has been established, the method continues with the step 138 of automatically sending the sensor 30 signals and the video signals to the user device 36. Thus, the user device 36 can display the all of the conditions being recorded by the sensors 30 in the building 22 and the video being captured by the cameras 34 positioned throughout the building 22.

The method then continues with the step 140 of changing the hierarchy of notification methods according to the time of the day, the day of the week, the location of the building 22 that the emergency condition took place in or the type of emergency condition.

The method then continues with the step 142 of automatically sending the notification message from the monitoring device 24 or the monitoring database 32 to one of the contacts via a first notification method at the top of the hierarchy in response to an emergency condition being established. When the notification message has been sent, the monitoring device 24 or monitoring database 32 waits a predetermined amount of time. During that predetermined amount of time, the method continues with the step 144 of receiving a response with the monitoring device 24 or the monitoring database 32 from the contact as one of accepted, rejected, or unresponsive. If the notification message is accepted by the contact, then the monitoring database 32 notifies the contact of the details of the emergency condition, e.g. one of the smoke sensors 30 sensed smoke in the building 22 or one of the structural sensors 30 sensed that one of the windows had been broken.

If the contact rejected or did not respond to the notification message, then the method continues with the step 146 of automatically sending the notification message to at least one of the same contact through a different notification method than the first notification method and to a different contact according to the hierarchy until the monitoring device 24 or the monitoring database 32 receives an accepted response from one of the contacts. In other words, the monitoring device 24 or the monitoring database 32 continues to send the notification message to contacts through the hierarchy until the notification message is accepted. Preferably, if a contact rejects the notification message, then the monitoring device 24 or monitoring database 32 moves onto another contact rather than sending the notification message to the same contact through a different notification method.

Obviously, many modifications and variations of the present invention are possible in light of the above teachings and may be practiced otherwise than as specifically described while within the scope of the appended claims. That which is prior art in the claims precedes the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A method of operating a security system in a building comprising the steps of:

establishing a database including a plurality of contacts and wherein at least one of the contacts has a plurality of notification methods, arranging the plurality of contacts and notification methods in the database into a hierarchy that varies based on at least the time of day and the day of the week and different locations within the building and on different types of emergencies and wherein for at least one combination of time of day, day of week, location within the building and type of emergency, the contact at the top of the hierarchy is a not an emergency responder, establishing an emergency condition, automatically sending only a single notification message to one of the contacts via a first notification method according to the hierarchy in response to the emergency condition being established and not sending the notification message to any emergency responder if the contact according to the hierarchy is not an emergency responder, receiving a response from the contact as one of accepted and rejected and unresponsive, and automatically sending the notification message to at least one of the same contact through a different notification method than the first notification method and to a different contact according to the hierarchy until one of the contacts accepts the notification message.

2. The method as set forth in claim 1 wherein the monitoring database includes a panic button and wherein the step of establishing an emergency condition is further defined as establishing an emergency condition in response to the panic button being depressed.

3. The method as set forth in claim 1 further including the step of sensing a condition of building with a sensor and generating a sensor signal associated with the condition.

4. The method as set forth in claim 3 further including the step of comparing the sensor signal with a predetermined emergency value.

5. The method as set forth in claim 4 wherein the step of establishing an emergency condition is further defined as establishing an emergency condition in response to the sensor signal exceeding the predetermined emergency value.

6. The method as set forth in claim 3 further including the step of establishing an internet protocol (IP) address for the monitoring device to connect the monitoring device to the Internet.

7. The method as set forth in claim 6 further including the steps of providing a monitoring database and establishing an internet protocol (IP) address for the monitoring database to connect the monitoring database to the Internet and establishing communication between the monitoring device and the monitoring database.

8. The method as set forth in claim 7 further including the steps of providing a camera in the building and capturing a video of the building with the camera and generating a video signal with the camera.

9. The method as set forth in claim 8 further including the step of sending the sensor and video signals from the monitoring device to the monitoring database via the Internet.

10. The method as set forth in claim 9 further including the step of storing the sensor and video signals on the monitoring database.

11. The method as set forth in claim 6 further including the steps of providing a user device and establishing an internet protocol (IP) address for the user device to connect the user device to the Internet.

12. The method as set forth in claim 11 further including the step of establishing communication between the user device and the monitoring device over the Internet.

13. The method as set forth in claim 12 further including the step of sending the sensor and video signals from the monitoring device to the user device.

14. The method as set forth in claim 13 wherein the user device is one of the contacts.

15. A method of operating a security system including a plurality of sensors and a plurality of cameras and a user device and a monitoring database and a monitoring device having a panic button comprising the steps of:

establishing an internet protocol (IP) address for the monitoring device to connect the monitoring device to the Internet, connecting the monitoring device to the public switched telephone network (PSTN), establishing an internet protocol (IP) address for the user device to connect the user device to the Internet, establishing an internet protocol (IP) address for the monitoring database to connect the monitoring database to the Internet, connecting the monitoring database to the PSTN, establishing communication over the Internet between the monitoring database and the monitoring device, establishing a plurality of contacts and notification methods for contacting the contacts, arranging the notification methods into a hierarchy including a first notification method at the top of the hierarchy, sensing a condition of the building with each of the sensors and generating a sensor signal associate with the condition, sending the sensor signals from the sensors to the monitoring device, capturing a video of the building with each of the cameras and generating a video signal, sending the video signals from the cameras to the monitoring device, sending the sensor and video signals from the monitoring device to the monitoring database via the Internet, storing the sensor and video signals on one of the monitoring device and the monitoring database, comparing each of the sensor signals to a predetermined emergency value, establishing an emergency condition with one of the monitoring device and the monitoring database in response to one of the sensor signals exceeding the predetermined emergency value and in response to the panic button on the monitoring device being depressed, automatically sending a notification message from one of the monitoring device and the monitoring database to the user device in response to an emergency condition being established, receiving a response with one of the monitoring device and the monitoring database from the user device as one of accepted and rejected and unresponsive, automatically establishing communication between the user device and one of the monitoring device and the monitoring database in response to one of the monitoring device and the monitoring database receiving an accepted response from the user device, automatically sending the sensor signals and the video signals from one of the monitoring device and the monitoring database to the user device, and characterized by changing the hierarchy of notification methods according to the time of the day and the day of the week and the location of the building that the emergency condition took place in and the type of emergency condition and wherein for at least one combination of time of day, day of week, location within the building and type of emergency, the contact at the top of the hierarchy is a not an emergency responder, automatically sending the notification message from one of the monitoring device and the monitoring database to only one of the contacts via the first notification method at the top of the hierarchy in response to an emergency condition being established and not sending the notification message to any emergency responder if the contact according to the hierarchy is not an emergency responder, receiving a response with the one of the monitoring device and the monitoring database from the contact as one of accepted and rejected and unresponsive, and automatically sending the notification message to at least one of the same contact through a different notification method than the first notification method and to a different contact according to the hierarchy until one of the monitoring device and the monitoring database receives an accepted response from one of the contacts.

* * * * *